US009834347B2

(12) United States Patent
Larsson et al.

(10) Patent No.: US 9,834,347 B2
(45) Date of Patent: Dec. 5, 2017

(54) SEALING MEMBRANE WITH PULL-TAB

(71) Applicant: A&R Carton Lund AB, Lund (SE)

(72) Inventors: Lennart Larsson, Malmö (SE); Simon Holka, Staffanstorp (SE); Eva Sunning, Lund (SE)

(73) Assignee: A&R Carton Lund AB, Lund (SE)

( * ) Notice: Subject to any disclaimer, the term of this patent is extended or adjusted under 35 U.S.C. 154(b) by 0 days.

(21) Appl. No.: 14/432,148

(22) PCT Filed: Oct. 4, 2013

(86) PCT No.: PCT/EP2013/070705
§ 371 (c)(1),
(2) Date: Mar. 27, 2015

(87) PCT Pub. No.: WO2014/053635
PCT Pub. Date: Apr. 10, 2014

(65) Prior Publication Data

US 2015/0251825 A1 Sep. 10, 2015

(30) Foreign Application Priority Data

Oct. 4, 2012 (EP) ..... 12187199

(51) Int. Cl.
*B65D 51/22* (2006.01)
*B65D 77/20* (2006.01)
(Continued)

(52) U.S. Cl.
CPC ..... *B65D 51/228* (2013.01); *B65D 51/20* (2013.01); *B65D 53/04* (2013.01);
(Continued)

(58) Field of Classification Search
CPC .. B65D 51/228; B65D 53/04; B65D 77/2024; B65D 51/20; B65D 2251/0021; B65D 2251/0093; B65D 2577/205
(Continued)

(56) References Cited

U.S. PATENT DOCUMENTS 4,122,790 A 10/1978 Rowe et al.
4,324,343 A * 4/1982 Moller ..... B65D 17/502 220/260
(Continued)

FOREIGN PATENT DOCUMENTS

CN 1604869 A 4/2005
DE 202 06 548 U1 7/2003
(Continued)

OTHER PUBLICATIONS

International Search Report dated Dec. 9, 2013 for International Application No. PCT/EP2013/070705.
(Continued)

*Primary Examiner* — James N Smalley
(74) *Attorney, Agent, or Firm* — Brinks Gilson & Lione

(57) ABSTRACT

The invention concerns a sealing membrane (2) for a container (5), said membrane (2) having an edge region (4) intended to be secured around an opening (5*a*) of the container (5) such as to form a sealing of the container (5), the membrane (2) comprising a pull-tab (1) extending from a portion of the edge region (4) such as to facilitate simplified release of the membrane (2). The invention is characterized in 12 that the pull-tab (1) comprises a stiffening structure (7) arranged in a pattern that defines an intended folding line (3) extending across the pull-tab (1). The invention also concerns a container arrangement (8) comprising a container (5) with an opening (5*a*) and, at least partly secured to the container (5) around the opening (5*a*),
(Continued)

a sealing membrane (2) of the above type. The invention also concerns a method of manufacturing a sealing membrane (2) of the above type, wherein the method comprises the step of embossing, corrugation, creasing, folding and/or heat shaping the stiffening structure (7).

17 Claims, 6 Drawing Sheets

(51) Int. Cl.
*B65D 51/20* (2006.01)
*B65D 53/04* (2006.01)

(52) U.S. Cl.
CPC .. *B65D 77/2024* (2013.01); *B65D 2251/0021* (2013.01); *B65D 2251/0093* (2013.01); *B65D 2577/205* (2013.01)

(58) Field of Classification Search
USPC ..... 220/258.1–258.3, 359.1–359.4; 215/232
See application file for complete search history.

(56) References Cited

U.S. PATENT DOCUMENTS

| | | | | |
|---|---|---|---|---|
| 4,693,390 | A | 9/1987 | Hekal | |
| 4,757,914 | A * | 7/1988 | Roth | B32B 15/08 215/232 |
| 8,225,954 | B1 | 7/2012 | Triquet et al. | |
| 2003/0189048 | A1 * | 10/2003 | Luburic | B65D 43/0256 220/276 |
| 2005/0045633 | A1 * | 3/2005 | Roeterdink | B65D 17/502 220/254.1 |
| 2005/0247712 | A1 * | 11/2005 | Wallis | B32B 27/08 220/359.2 |
| 2007/0145001 | A1 * | 6/2007 | Tilton | B65D 51/20 215/383 |
| 2008/0156808 | A1 * | 7/2008 | Perry | B65D 25/2897 220/560.03 |
| 2011/0315703 | A1 * | 12/2011 | Urushidani | B65D 43/0204 220/805 |

FOREIGN PATENT DOCUMENTS

| | | |
|---|---|---|
| GB | 1 244 338 A | 8/1971 |
| JP | S33-019682 | 12/1958 |
| JP | H04-106243 U | 9/1992 |
| JP | H07-002276 A | 1/1995 |
| JP | 2004123191 A | 4/2004 |
| RU | 2 448 884 C2 | 6/2011 |

OTHER PUBLICATIONS

Office Action dated May 22, 2017 for Japanese Application No. 2015-535030 (English translation and Japanese original).
English Translation of Decision to Grant dated Aug. 31, 2017 for Russian Application No. 2015116448.

* cited by examiner

SEALING MEMBRANE WITH PULL-TAB

This application claims the benefit under 35 U.S.C. §371 of International Application No. PCT/EP2013/070705, filed Oct. 4, 2013, which claims the benefit of European Patent Application No. 12187199.0, filed Oct. 4, 2012 which are incorporated by reference herein in their entirety.

TECHNICAL FIELD

The present invention relates to a sealing membrane for sealing of an opening of a container, wherein the sealing membrane has an edge portion and comprises a pull-tab extending from a portion of the edge region such as to facilitate simplified release of the membrane from the container. The invention also relates to a container comprising such a membrane and a method for manufacturing such a membrane.

BACKGROUND ART

Containers for storing e.g. food products require a tight seal in order to be leak-tight or hermetic for hygienic or shelf-life reasons. One way of tightly sealing containers filled with powder or other food products is to bond or seal a membrane to the inner walls or to an edge or lip extending around the opening of the container. Such membranes are often arranged so that they may be easily removed from the container by a tearing force applied by the user, and the membranes are hence often provided with pull-tabs that extend from an end region thereof and that are easy to grip. U.S. Pat. No. 8,225,954 describes a sealing membrane comprising such a pull-tab.

Containers provided with sealing membranes are commonly provided with an outer lid of stiffer material e.g. made of cardboard or plastic material, such that the outer lid protects the sealing membrane as well as the pull-tab from punctures or ruptures. The outer lid is commonly arranged onto the container after the sealing membrane is applied. The pull-tab may be impacted in a non-desirable way by the outer lid as the outer lid is positioned at the opening of the container. To avoid this, the extending pull-tab may be pre-bent or pre-folded before the outer lid is applied to the container.

U.S. Pat. No. 4,122,790 describe a container with a stiff outer lid and a pre-bent pull-tab. The sealing membrane is severed by punching means from a transversely travelling web material during the manufacturing process. The membrane is sealed to the edge of the opening of the container and the pull-tab, extending from the sealing membrane, is subsequently laterally bent along the edge of the container before the outer lid is applied to the container.

Due to the small size of the pull-tab, the production speed and the difficulties in controlling the exact position of the container, it is generally a challenge to provide equipment that pre-bends or pre-folds the pull-tab in a desired and consistent way. Usually, a rod or plate is used to bend the pull-tab when the container passes the rod/plate in the production line, or the outer lid is used to bend the pull-tab when applied onto the container. This leads normally to an uncontrolled bending of the pull-tab, which in turn may lead to folding errors or collapsing of the pull-tab such that it becomes difficult to grip. Thereby, the tear-off mechanism of the membrane is affected, and the user-friendliness of the membrane is consequently reduced.

Additional steps during or after the manufacturing process to achieve a proper shaping of the pull-tab have been proposed but makes the manufacturing more costly.

There is thus a need for improvements that facilitates proper shaping/bending of sealing membrane pull-tabs in the production of containers with such membranes.

SUMMARY

An object of the present invention is to provide an inventive sealing membrane with pull-tab for a container where the previously mentioned problems are avoided or at least reduced. This object is achieved by the membrane defined in claim 1. Further objects are to provide a container comprising such a membrane and to provide a method for producing such a membrane.

The invention concerns a sealing membrane for a container, said membrane having an edge region intended to be secured around an opening of the container such as to form a sealing of the container, the membrane comprising a pull-tab extending from a portion of the edge region such as to facilitate simplified release of the membrane.

The invention is characterized in that the pull-tab comprises a stiffening structure arranged in a pattern that defines an intended folding line extending across the pull-tab.

Such a stiffening structure facilitates controlled folding of the pull-tab along the intended folding line, and reduces the risk for unwanted and uncontrolled folding of the pull-tab at other position due to its stiffening properties. Thereby, the configuration and form of the pre-folded/pre-bent pull-tab can be controlled when the container passes a rod or plate in the production line, even if the position of the container cannot be controlled exactly, or when an outer lid is applied onto the container.

A substantially increased stiffness can be given the stiffening structure by embossing or corrugating in a pressing operation a certain pattern in a certain area of the pull-tab, possibly simultaneously with punch pressing of the membrane. Stiffness in several directions can be achieved by giving the pattern a desired distribution, the pattern can for instance have the shape of a fan with elongated stiffening elements directed in relation to each other like a number of spokes in a part of a wheel (but with different length). By interrupting the pattern along an imaginary line it is possible to define an intended folding line along which the pull-tab will bend and fold when subjected to a force. The pattern may include an embossing/corrugation line that extends along the intended folding line. The intended folding line may be straight, curved and/or include sections exhibiting an angle to an adjacent section. A wider intended folding line, a folding zone, may be used to allow folding over a larger area. The intended folding line extends normally across the entire width of the pull-tab, from side to side, but the stiffening structure may extend only partly across width; it can still define the intended folding line.

With sufficient depth of the corrugations or similar in the pull-tab a user can still get a good grip of the pull-tab even if it is folded towards a centre point of the membrane so as to end up in a position parallel to the membrane; the distance between the pull-tab and the upper side of the membrane will still be sufficient.

In an embodiment of the invention the stiffening structure is achieved by forming elevations and depressions in at least parts of the pull-tab. Accordingly, the stiffening structure comprises elevations and depressions in the membrane material. The forming of elevations and depressions in the sealing membrane may comprise embossing, corrugation, creasing, folding, heating or any other suitable manipulation. The elevations and depressions increase the stiffness of the pull-tab such that folding is directed along the intended folding line.

In an embodiment of the invention the intended folding line extends in a direction substantially parallel with the portion of the edge region. Thereby, the pull-tab will fold in a direction that is advantageous in many applications. The edge region may be straight or bent depending on the form and position of the sealing membrane.

In an embodiment of the invention the stiffening structure comprises a plurality of elongated stiffening elements extending from the intended folding line towards an outer edge of the pull-tab. Elongated stiffening elements inhibit other folding lines to form, hence the pull-tab will not fold parallel to the edge region at any other position other than along the intended folding line when affected by an external force such as a bending force. Each stiffening element is preferably an elongated elevation or depression.

The elongated stiffening elements preferably extend from a central region of the intended folding line towards the outer edge of the pull-tab. However, the exact pattern can be varied depending on the shape of the pull tab, its intended folding direction if any and the expected direction of the force that will affect and eventually bend the pull tab. The stiffening elements thereby inhibit folding lines to form in a direction parallel to the direction in which the pull-tab extends. By selecting direction of the stiffening elements the pull tab can be made stiff in other directions than parallel to its elongation. For instance, by arranging the stiffening means at angles like a fan or other suitable pattern the entire pull tab can be made stiff to withstand unwanted bending in any direction. The pull-tab thus remains stiff and in its original form even when subjected to external forces. A stiff pull-tab that is not folded, other than along its intended folding line, is easier to grip by the user.

In one example of the invention the elongated stiffening elements are substantially straight. Straight stiffening elements are formed, e.g. through corrugation of the pull-tab during manufacturing.

The stiffening structure may further comprise an elongated stiffening element that extends along the intended folding line. Such a stiffening element reinforces the intended folding line so that the folding position is further controlled.

Preferably the portion of the edge region from which the pull-tab extends is curved. Further, the edge region preferably forms part of a rounded corner of the sealing membrane. A pull-tab that extends from a corner of the membrane facilitates easy release of the membrane from the container. When a pull-tab that extends from a corner of the membrane is pulled it will exercise release forces along two edges of the membrane at the same time, hence release of the membrane is simplified.

The material of the sealing membrane may vary depending on the intended usage of the container provided with the sealing membrane. The sealing membrane may comprise a layer of aluminium and/or a layer of a plastic material, such as polyethylene or polypropene. The sealing membrane may thus be a laminated layer structure comprising a layer of aluminium and a layer of a weldable plastic material. A layer of aluminium can easily be embossed or corrugated and keeps its shape, i.e. its stiffening structure in a good way. A plastic material may be heat-treated to obtain its stiffening structure.

The invention also concerns a container arrangement comprising a container with an opening and, at least partly secured to the container around the opening, a sealing membrane of the above type. In an embodiment of the container arrangement, the edge region of the membrane is folded and secured to inner walls of the container.

The invention also concerns a method of manufacturing a sealing membrane of the above type, wherein the method comprises the step of embossing, corrugation, creasing and/or folding the stiffening structure.

BRIEF DESCRIPTION OF THE DRAWINGS

The present invention will now be described in detail with reference to the figures, wherein.

DETAILED DESCRIPTION

In the following only one embodiment of the invention is shown and described, simply by way of illustration of one mode of carrying out the invention.

Figure 1:
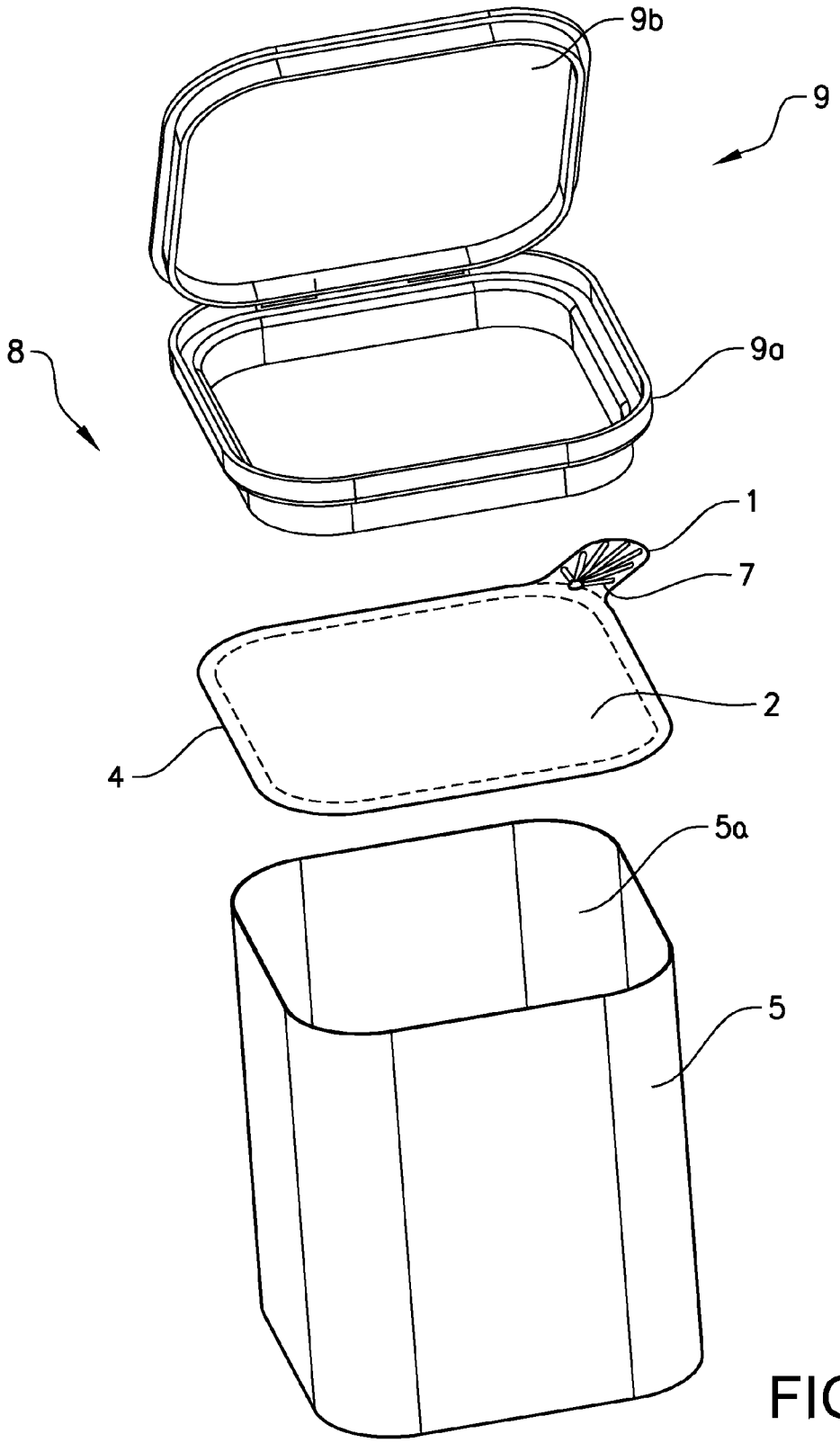
FIG. 1 shows, in an exploded view, a container, an outer lid and an embodiment of the inventive sealing membrane.

FIG. 1 shows, in an exploded view, a container arrangement 8 comprising a container 5 with an opening 5*a*, a sealing membrane 2 and an outer lid 9 comprising a lid frame 9*a* connected to a hinged openable lid 9*b*. As an example of known materials for such a container arrangement 8, the container 5 is a laminated structure comprising layers of cardboard, aluminium and a plastic weldable layer, the membrane 2 is also a laminated structure comprising layers of aluminium and a plastic weldable layer, and the outer lid 9 is made of a plastic material. Other materials are possible to use.

Figure 2:
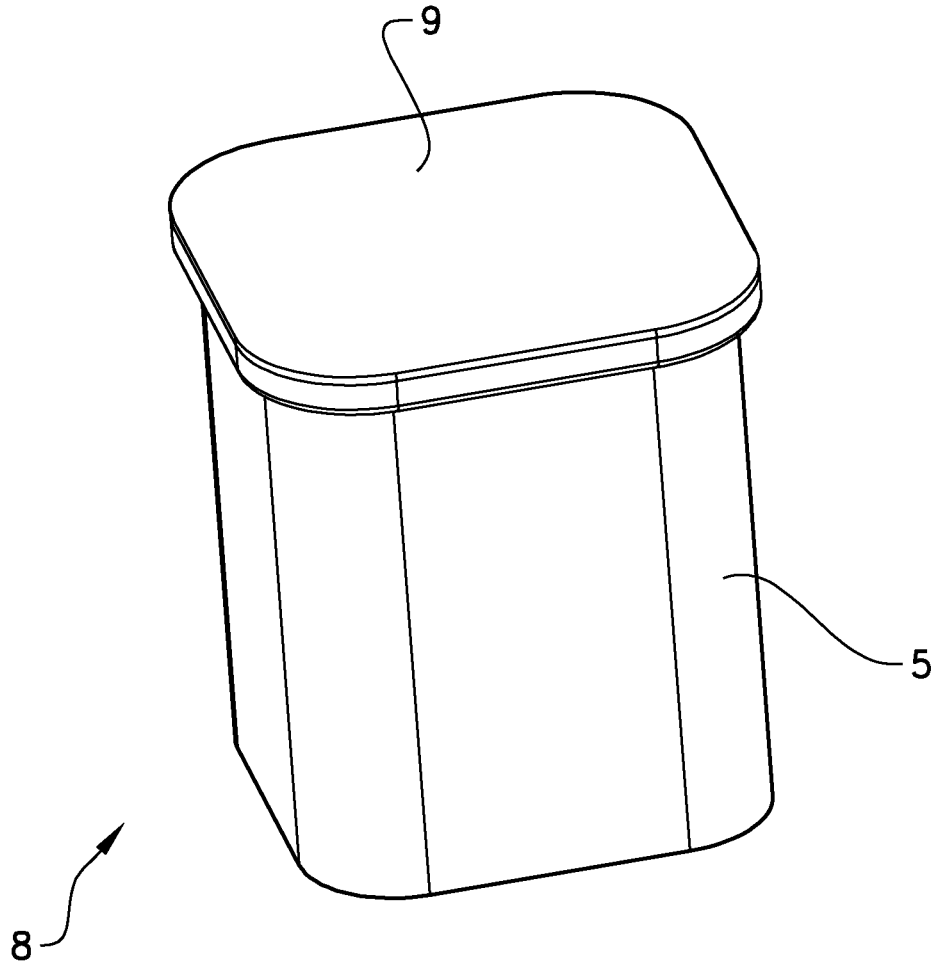
FIG. 2 shows the parts of FIG. 1 in an assembled state.
Figure 4:
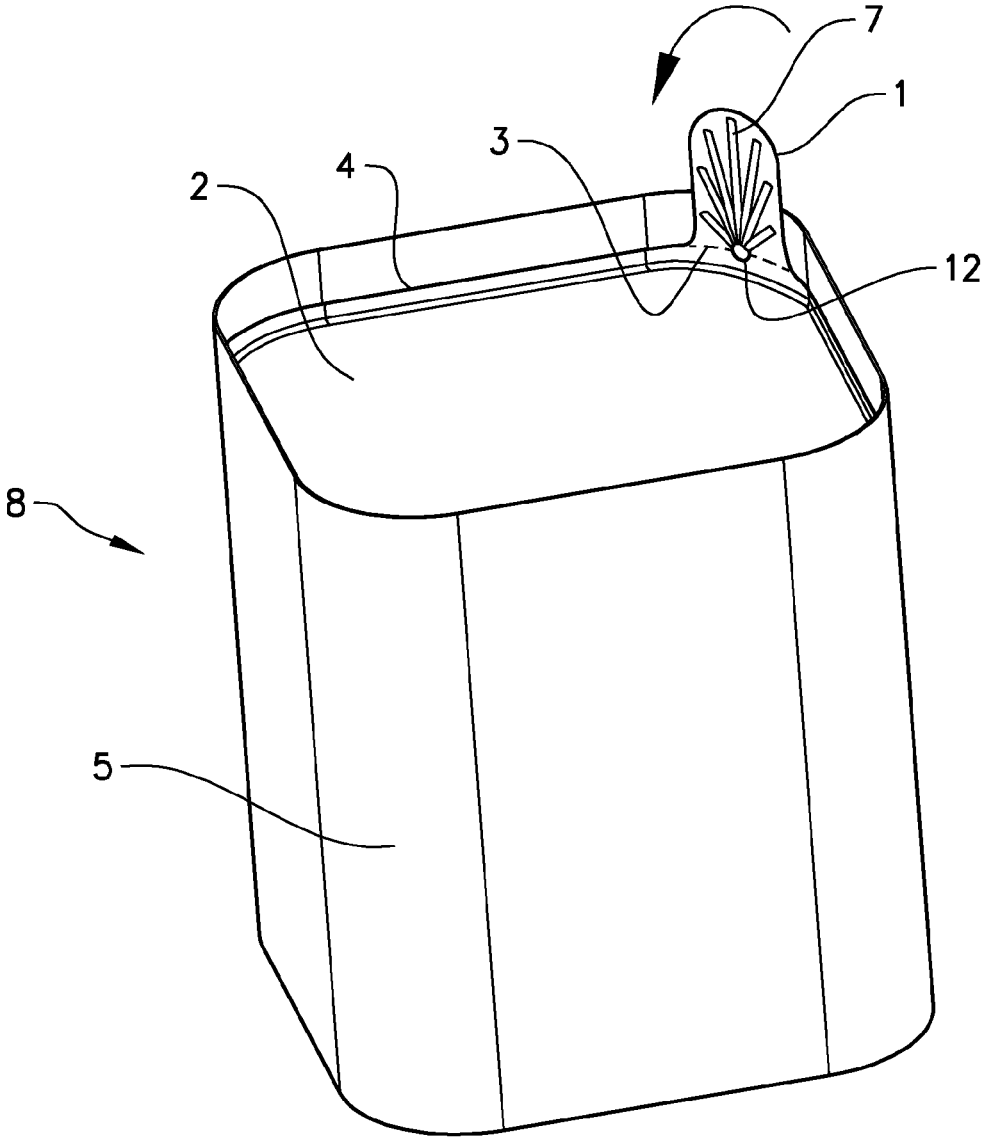
FIG. 4 shows the sealing membrane according to FIG. 1 secured to the container with the pull-tab pointing upwards.
Figure 5:
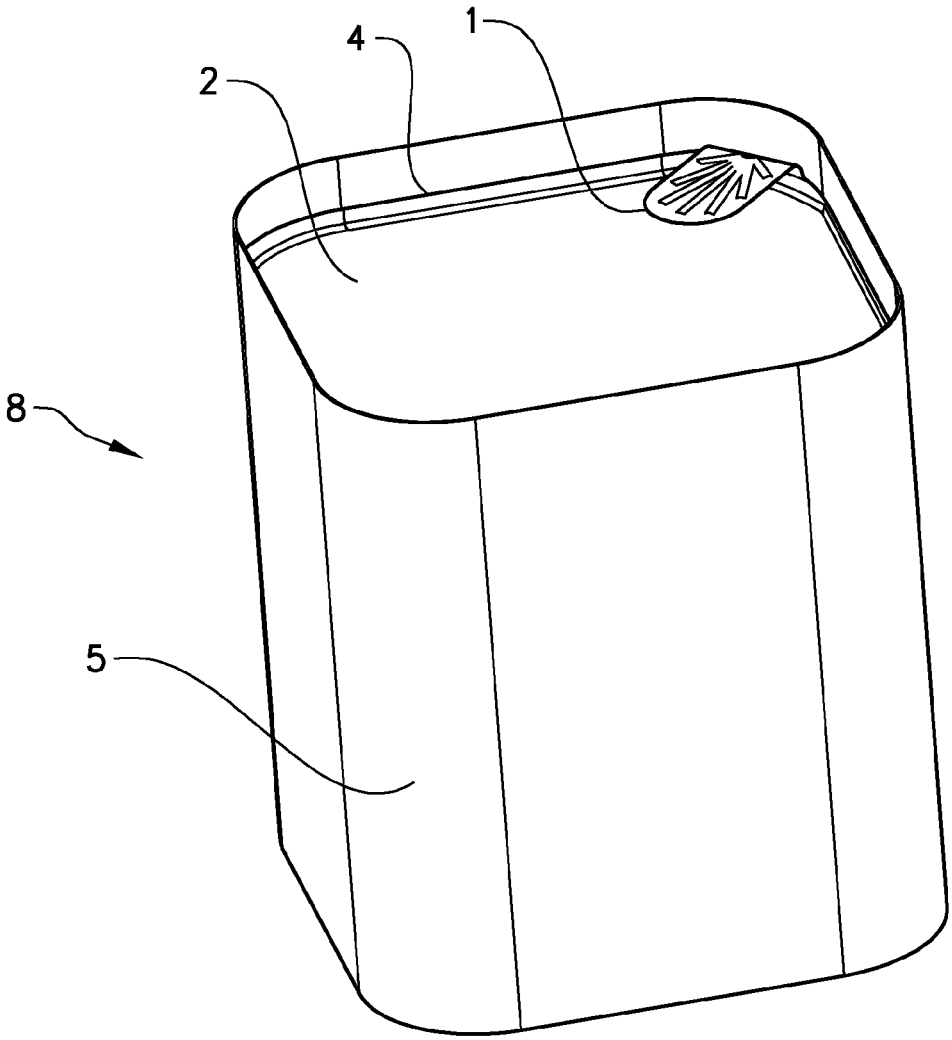
FIG. 5 shows the sealing membrane according to FIG. 1 secured to the container and with the pull-tab folded towards the membrane.
Figure 6:
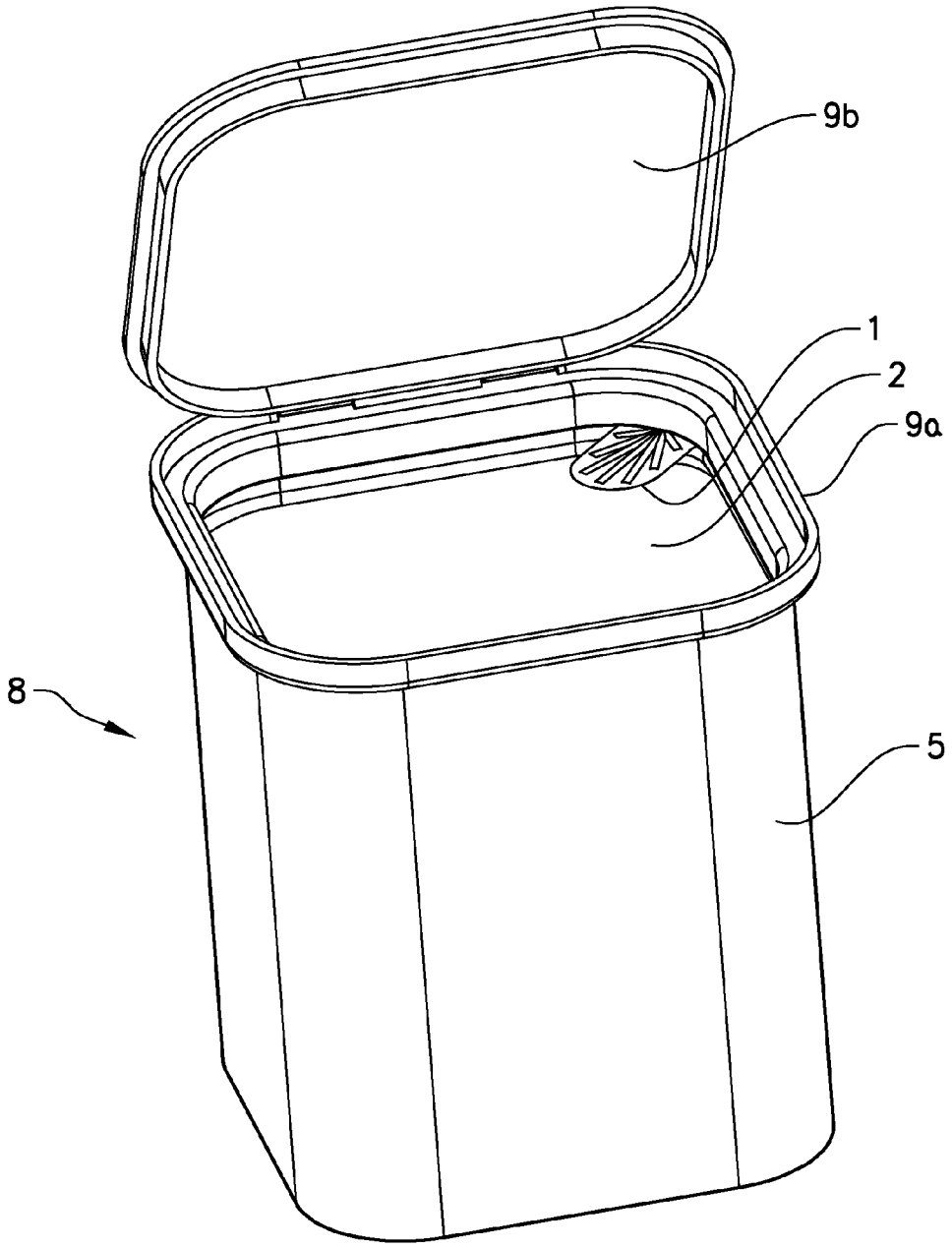
FIG. 6 shows an opened outer lid mounted onto the container according to FIG. 5.

After filling of the container 5 with e.g. a food product in powder form, the container 5 is sealed by securing the membrane 2 around the opening 5*a* by fastening an edge portion 4 of the membrane 2 to the inner walls of the container 5 (see FIGS. 4-6). The outer lid 9 is attached to the container 5 by known means by pressing the outer lid 9 onto an upper rim of the container 5 above the sealing membrane (see FIG. 6). FIG. 2 shows the container arrangement 8 in an assembled state.

Figure 3:
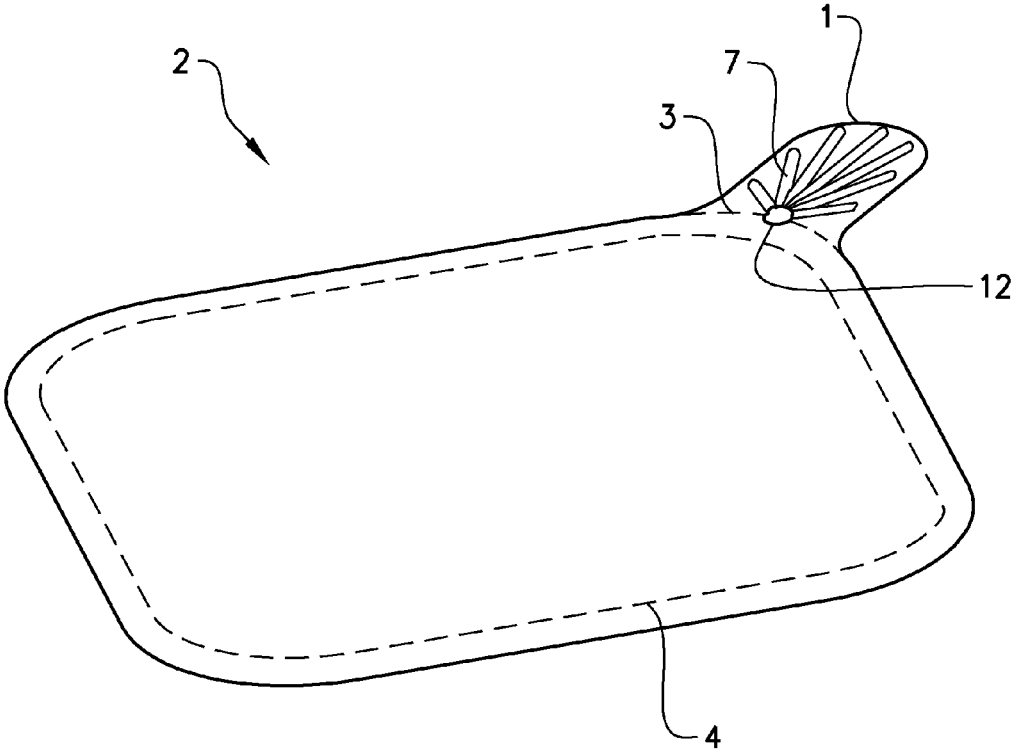
FIG. 3 shows the sealing membrane according to FIG. 1.

FIG. 3 shows in an enlarged view the sealing membrane 2 of FIG. 1. As can be seen in FIG. 3, the edge region 4 extends circumferentially around the sealing membrane 2. A pull-tab 1 for facilitating release of the membrane 2 extends from a portion of the edge region 4 located at a rounded corner of the membrane 2. The pull-tab 1 has a base, a top and two sides, wherein the base is connected to the sealing membrane 2.

The pull-tab 1 further comprises a stiffening structure 7 arranged in a pattern that defines an intended folding line, indicated with the line 3, extending across the pull-tab 1.

The stiffening structure 7 is made up of elongated stiffening elements in the form of elevations and depressions formed by, in this case, embossing. The intended folding line 3 extends in this case in a direction substantially parallel with the portion of the edge region 4 across the pull-tab 1 from side to side and through a punched hole 12. This hole 12 has the purpose of improving the inductive heat sealing process (it affects the current density) when securing the membrane to the container 5. The punched hole 12 is not necessary for the present invention but if present it is normally an advantage to direct the intended folding line 3 through the hole 12.

The position of the intended folding line 3 is set by the pattern of the stiffening structure 7. FIG. 3 shows that the stiffening structure 7 comprises a plurality of elongated straight stiffening elements extending from a central region, in this case the hole 12, of the intended folding line 3 towards an outer edge of the pull-tab 1. In this example, the most central stiffening element is parallel to the main direction of extension of the pull-tab 1, i.e. it forms an extension of a diagonal of the membrane 2. This central stiffening element extends from the central region of the intended folding line 3 towards the outermost edge of the pull-tab 1.

A number of additional elongated straight stiffening elements, in this case three on each side of the most central stiffening element, extend also from the central region of the intended folding line 3 towards the edge of the pull-tab 1. All stiffening elements have a unique extension direction, i.e. there are no parallel stiffening elements. The three stiffening elements on each side of the central stiffening element exhibits an angle of about 12, 25 and 50 degrees, respectively, to the central stiffening element. Thereby, the seven stiffening elements form the pattern of a fan. Folding is thereby prevented or at least made more difficult except along the intended folding line 3 across the pull-tab 1 through the central region of the folding line 3.

As can be seen in the figures the stiffening elements merge close to the hole 12. In other embodiments the stiffening elements can be entirely separated or only touch each other at, for instance, the central region. Such stiffening elements can be interrupted at, or start from, positions distributed along an imaginary line that then will define the intended folding line 3 along which the pull-tab will bend and fold when subjected to a force.

In this case the true folding line is allowed to deviate up to around 40 degrees from the intended folding line 3 as the pull-tab 1 may be folded along one or both of the stiffening elements positioned closest to the intended folding line 3. These stiffening elements exhibit an angle of around 40 degrees to the intended folding line 3 (as they exhibit an angle of around 50 degrees to the central stiffening element that is perpendicular to the intended folding line 3). The true folding line will, however, be forced to extend through the central region of the intended folding line 3 (through the hole 12) and can thus be controlled. To control the true folding line in more detail, a stiffening element can be arranged close to and in parallel with the intended folding line 3. Further control of the true folding line can be achieved by arranging parallel stiffening elements on each side of the intended folding line 3.

An example of a suitable way of accomplishing the stiffening structure 7 is embossing a aluminium sheet of 38 μm laminated against 30 μm PE sheet to a embossing depth of 0.2-0.3 mm. An elevation/depression depth of down to 0.1 mm may also be suitable for such a membrane as long as the pull-tab 1 does not fold unintentionally or uncontrolled. The exact depth and shape of the stiffening elements, as well as the exact pattern of the stiffening structure 7, can be adapted to the situation, i.e. to the dimensions and material of the membrane to be used, the size of the pull-tab, the type and size of container, etc.

FIG. 4 shows the sealing membrane 2 secured to the container 5 with the pull-tab 1 pointing upwards. The edge portion 4 of the membrane 2 is folded upwards and has been welded onto the inner walls of the container 5 around its opening 5*a*. An arrow indicates the intended folding direction for the pull-tab 1. This folding can be carried out as has been done conventionally, but due to the defined intended folding line 3 the folding can now be carried out in a controlled manner. This means that it is possible to predetermine the position of the real folding line created in e.g. an automated folding step in a container assembly production line. The pattern of the stiffening structure 7 can be adapted to the particular requirement for folding line positioning in a particular application, i.e. if it is important to control the exact position of the true folding line the stiffening structure pattern can be adapted so that the intended and the true folding line coincide (e.g. with parallel stiffening elements on each side of the folding line, see above). If the position and extension of the true folding line can be allowed to vary within a certain range, the stiffening structure may have a simpler pattern that only directs the true folding to a certain intended folding zone. In such a case the intended folding line 3 can be regarded as the most probable position for the true folding line.

FIG. 5 shows the sealing membrane 2 and the container 5 according to FIG. 4 but after folding of the pull-tab 1 downwards towards the membrane 2. The pull-tab 2 has now been folded in a controlled manner along its intended folding line 3.

FIG. 6 shows the container assembly 8 with the outer lid 9 attached onto the container 5 with the frame 9*b* around the container opening 5*a* and the lid 9*b* opened. At this stage a user can easily lift and grip the folded pull-tab 1 and tear off the membrane 2.

Fastening of the membrane 2 to the container 5 around the opening 5*a* may be done by heat adhesion, inductive heat sealing or any other suitable way of sealing the container 5.

Reference signs mentioned in the claims should not be seen as limiting the extent of the matter protected by the claims, and their sole function is to make claims easier to understand.

As will be realised, the invention is capable of modification in various obvious respects, all without departing from the scope of the appended claims. Accordingly, the drawings and the description thereto are to be regarded as illustrative in nature, and not restrictive.

As an alternative to what is exemplified above, the sealing membrane 2 may be secured to a lip extending around the opening of the container 5. In such a case the pull-tab is typically folded downwards on the outer side of the lid/container. Also in such an application it is an advantage to make use of the inventive stiffening structure 7 for defining the intended folding line 3.

Further alternatives are that the pull-tab is placed at a straight part of the membrane, and not in a corner, and that the sealing membrane (and the opening) instead can be rounded (circular or oval).

Further, one or several stiffening elements may be curved to provide stiffness in different directions, and the angles between the stiffening elements, straight or curved, can be varied.

Forming the stiffening structure by heating (e.g. heated forming tools) is typically useful if the sealing membrane is entirely made of a plastic material or is a laminate of e.g. plastics and aluminium where the plastic layer has a sufficient (relative) thickness for retaining the shape of the stiffening structure.

The invention claimed is:

1. A sealing membrane for a container, said membrane comprising:

an edge region intended to be secured around an opening of the container to form a sealing of the container; and a pull-tab extending from a portion of the edge region to facilitate simplified release of the membrane, the pull-tab comprising a stiffening structure arranged in a pattern that defines an intended folding line extending across the pull-tab, the intended folding line is positioned in a zone extending from the portion of the edge region to a first end of the stiffening structure, the zone being free from stiffening structures from the portion of the edge region to the first end of the stiffening structure, wherein the stiffening structure comprises elevations and depressions formed in at least parts of the pull-tab and the stiffening structure comprises a plurality of elongated stiffening elements extending from the intended folding line towards an outer edge of the pull-tab, each stiffening element of the plurality of elongated stiffening elements having a first end and a second end and each of the plurality of elongated stiffening elements extending in a direction of extension that differs from each of the other stiffening elements of the plurality of elongated stiffening elements and the first end of each of the plurality of elongated stiffening elements extends towards the intended folding line and the second end of each of the plurality of elongated stiffening elements extends towards the outer edge of the pull-tab.

2. The sealing membrane according to claim 1, wherein the stiffening structure comprises embossed, corrugated, creased, folded or heat-shaped material.

3. The sealing membrane according to claim 1, wherein the intended folding line extends in a direction substantially parallel with the portion of the edge region.

4. The sealing membrane according to claim 1, wherein the plurality of elongated stiffening elements extends from a central region of the intended folding line towards the outer edge of the pull-tab.

5. The sealing membrane according to claim 1, wherein the plurality of elongated stiffening elements are substantially straight.

6. The sealing membrane according to claim 1, wherein the portion of the edge region from which the pull-tab extends is curved.

7. The sealing membrane according to claim 1, wherein the sealing membrane comprises a layer of aluminium.

8. The sealing membrane according to claim 1, wherein the sealing membrane comprises a layer of a plastic material.

9. The sealing membrane according to claim 8, wherein the layer of the plastic material comprises polyethylene or polypropene.

10. The sealing membrane according to claim 1, wherein the sealing membrane is a laminated layer structure comprising a layer of aluminium and a layer of a weldable plastic material.

11. A method of manufacturing a sealing membrane according to claim 1, wherein the method comprises the step of embossing, corrugation, creasing, folding and/or heat shaping the stiffening structure.

12. The sealing membrane according to claim 1, wherein the portion of the edge region from which the pull-tab extends forms part of a rounded corner of the sealing membrane.

13. The sealing membrane according to claim 1, wherein the pull-tab further comprises a hole formed in the pull-tab.

14. The sealing membrane according to claim 13, wherein the intended folding line extends through the hole.

15. A container arrangement comprising a container with an opening and, at least partly secured to the container around the opening, a sealing membrane, the sealing membrane comprising an edge region secured around the opening of the container to form a sealing of the container, the membrane comprising a pull-tab extending from a portion of the edge region to facilitate simplified release of the membrane, the pull-tab comprising a stiffening structure arranged in a pattern that defines an intended folding line extending across the pull-tab, the intended folding line is positioned in a zone extending from the portion of the edge region to a first end of the stiffening structure, the zone being free from stiffening structures from the portion of the edge region to the first end of the stiffening structure, wherein the stiffening structure comprises elevations and depressions formed in at least parts of the pull-tab and the stiffening structure comprises a plurality of elongated stiffening elements having a first end and a second end and each of the plurality of elongated stiffening elements extending from the intended folding line towards an outer edge of the pull-tab, each stiffening element of the plurality of elongated stiffening elements extending in a direction of extension that differs from each of the other stiffening elements of the plurality of elongated stiffening elements and the first end of each of the plurality of elongated stiffening elements extends towards the intended folding line and the second end of each of the plurality of elongated stiffening elements extends towards the outer edge of the pull-tab.

16. The container arrangement according to claim 15, wherein the edge region of the membrane is folded and secured to inner walls of the container.

17. A sealing membrane for a container, said membrane comprising:

an edge region intended to be secured around an opening of the container to form a sealing of the container; and a pull-tab extending from a portion of the edge region to facilitate simplified release of the membrane, the pull-tab comprising a stiffening structure arranged in a pattern that defines an intended folding line extending across the pull-tab, the intended folding line is positioned in a zone extending from the portion of the edge region to a first end of the stiffening structure, wherein the stiffening structure comprises elevations and depressions formed in at least parts of the pull-tab and the stiffening structure comprises a plurality of elongated stiffening elements extending from a common point of origin on the intended folding line towards an outer edge of the pull-tab, each stiffening element of the plurality of elongated stiffening elements having a first end and a second end and each of the plurality of elongated stiffening elements extending in a direction of extension that differs from each of the other stiffening elements of the plurality of elongated stiffening elements and the first end of each of the plurality of elongated stiffening elements extends towards the intended folding line and the second end of each of the plurality of elongated stiffening elements extends towards the outer edge of the pull-tab.

* * * * *